US006081195A

United States Patent [19]

Lynch

[11] Patent Number: 6,081,195

[45] Date of Patent: Jun. 27, 2000

[54] SYSTEM FOR MONITORING OPERABILITY OF FIRE EVENT SENSORS

[76] Inventor: Adam Q. Lynch, 75 N. Lakeside Dr., Madison, Ind. 47250

[21] Appl. No.: 09/237,817

[22] Filed: Jan. 27, 1999

Related U.S. Application Data

[60] Provisional application No. 60/072,850, Jan. 28, 1998.

[51] Int. Cl.[7] ..... G08B 17/12

[52] U.S. Cl. ..... 340/577; 340/577; 340/515; 340/507; 340/506

[58] Field of Search ..... 340/577, 515, 340/507, 506, 521, 522, 635, 514

[56] References Cited

U.S. PATENT DOCUMENTS

| | | | |
|---|---|---|---|
| 3,802,249 | 4/1974 | Clawson . | |
| 4,088,986 | 5/1978 | Boucher . | |
| 4,453,159 | 6/1984 | Huff et al. . | |
| 4,575,711 | 3/1986 | Suzuki | 340/521 |
| 4,595,914 | 6/1986 | Siegel | 340/515 |
| 4,764,758 | 8/1988 | Skala . | |
| 4,881,060 | 11/1989 | Keen et al. | 340/511 |
| 4,965,556 | 10/1990 | Brodecki et al. | 340/628 |
| 5,121,101 | 6/1992 | Jakubowski . | |
| 5,619,184 | 4/1997 | Torikoshi et al. | 340/506 |
| 5,793,297 | 8/1998 | Takeuchi et al. | 340/635 |

*Primary Examiner*—Jeffery A. Hofsass
*Assistant Examiner*—Hung T. Nguyen
*Attorney, Agent, or Firm*—Chase & Yakimo, L.C.

[57] ABSTRACT

A system for monitoring the operability of fire event sensors having a programmable logic circuit which automatically and continuously analyzes whether readings obtained from fire event sensors satisfy multiple predetermined parameters. Parameters defining operability may include the mere receipt of a signal from a sensor, elapsed time between signals, substantive quality of signals, sensor sensitivity, strength of power source, or other parameters. The parameters are modifiable to facilitate many different types of sensors without the addition of any additional circuitry. The system also includes manual testing of the self-checking routine itself as well as checking the circuitry of a fire detection unit and strength of power source. Means for resetting the system is also provided.

20 Claims, 4 Drawing Sheets

SYSTEM FOR MONITORING OPERABILITY OF FIRE EVENT SENSORS

CROSS REFERENCE TO RELATED APPLICATIONS

This application claims the benefit of the prior filed, co-pending application Ser. No. 60/072,850, filed Jan. 28, 1998, entitled SYSTEM FOR MONITORING OPERABILITY OF FIRE EVENT SENSORS.

BACKGROUND OF THE INVENTION

This invention relates to fire event sensing devices and, more particularly, to a system for automatically monitoring the operability of fire event sensors housed within a fire event detection unit.

Although the percentage of U.S. households having at least one fire detection device of some type has grown to over 92%, the percentage of deaths caused by residential fires has remained steady. The fact that approximately one-third of all fire detection devices are non-operational when needed is a key reason for this unfortunate statistic. A large number of fire-related incidents involving property damage, personal injury, or even death are attributable to malfunctioning fire detection units. Malfunctioning smoke, heat, carbon monoxide, or other fire event sensors, or even dead or disconnected batteries, are often the result of a lack of manual testing by residents. It is therefore desirable to have a system for automatically testing the operability of sensors housed within a fire detection unit whether they are smoke, heat, carbon monoxide or other fire event sensors.

Several methods and devices have been proposed to monitor the operability of various fire event sensing devices. In U.S. Pat. No. 4,595,914 to Siegel, a self-test circuit for a fire event detector is disclosed for automatically periodically testing whether the sensitivity of an ionizationtype sensor is within a certain predetermined range. A fire event smoke alarm which automatically periodically tests the detector's operation or periodically sounds the detector's alarm to remind the occupant to manually test the alarm is disclosed in U.S. Pat. No. 4,965,556 to Brodecki. The prior art further includes several methods and devices for manually checking the functionality of combustion detection circuitry.

Although assumably effective in operation, such known methods and devices are incapable of monitoring the integrity and functionality of multiple types of fire event sensors housed within a single detection unit. In addition, the above referenced devices only provide a single test of integrity or operability, such as simulating a fire event within a predetermined fixed range of sensitivity or merely detecting whether any signal is received from a sensor. Significantly, the acceptable range of sensor sensitivity, actions to be taken based on self-test results, and the frequency of periodic checking can not be modified or adjusted without the replacement or addition of new circuitry. Further, the referenced devices do not allow the residential occupant to verify that the self-checking circuitry itself is functioning properly.

It is therefore desirable to have a system which automatically checks multiple parameters related to the integrity and operability of fire event sensors housed within a fire detection unit. It is also desirable that the monitored parameters be modifiable without the replacement or addition of any circuitry.

SUMMARY OF THE INVENTION

In response thereto we have invented a system which automatically checks the integrity and operability of fire event sensors housed within a fire detection unit. The system disclosed herein utilizes a programmable master logic circuit which compares data received from each sensor with multiple predetermined parameters, such as threshold levels of logical readings, ranges of acceptable sensor sensitivity, acceptable time duration between sensor readings, existence of signal, strength of battery power, and other parameters. The master logic circuit can be reprogrammed with a different set of parameters without the need for additional circuitry. The system further provides for manual testing of the integrity of the circuitry and operability of the sensor monitoring system itself. An audible or visual alarm is activated if a sensor's readings violate any of the predetermined operability parameters, thus indicating a malfunction. The system further provides for manual resetting of all sensors following activation of any sensor.

It is therefore a general object of this invention to provide a system for monitoring the operability of fire event sensors which automatically tests the operability of each sensor.

Another object of this invention is to provide a system for monitoring the operability of fire event sensors which continuously tests the operability of each sensor.

Yet another object of this invention is to provide a system for monitoring the operability of fire event sensors having a programmable logic circuit which compares sensor readings to a plurality of parameters for determining if each sensor is operating correctly.

A further object of this invention is to provide a system for monitoring the operability of fire event sensors having a logic circuit that may be reprogrammed with a different set of parameters and associated logic without the addition of new circuitry.

A still further object of this invention is to provide a system for monitoring the operability of fire event sensors having a means for manually testing the integrity of all circuitry.

Another object of this invention is to provide a system for monitoring the operability of fire event sensors having a means for manually testing the operability of the sensor monitoring system itself.

A further object of this invention is to provide a system for monitoring the operability of fire event sensors which can manually reset an alarm or sensors following activation.

A still further object of this invention is to provide a system for monitoring the operability of fire event sensors which sounds an audible and/or visual alarm when at least one fire event sensor or a battery is malfunctioning.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
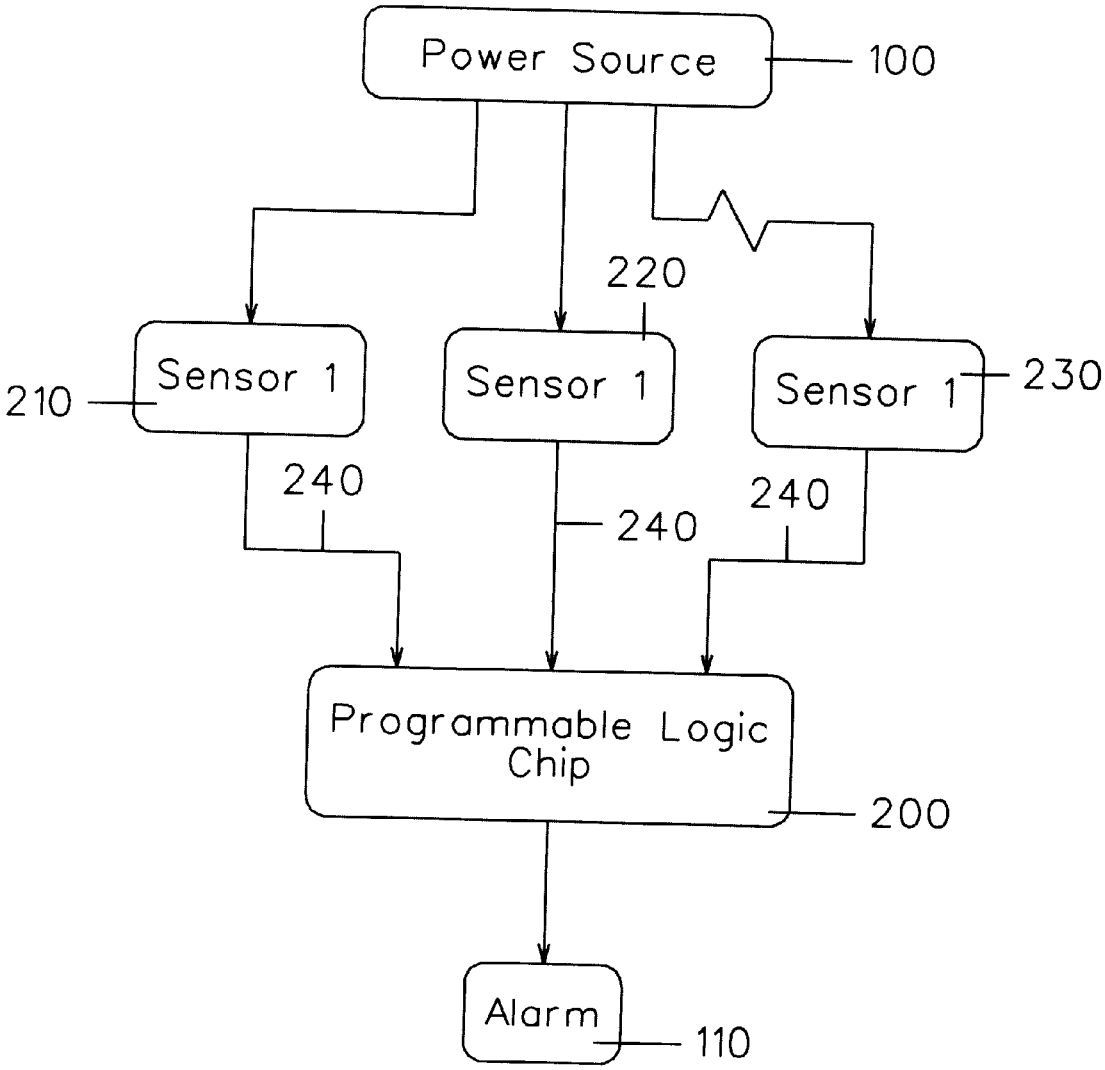
FIG. 1 is a block diagram of the monitoring system showing the major components of the monitoring system.

Turning more particularly to FIGS. 1–4, three fire event sensors 210, 220, 230 are shown which can sense various conditions of ambient air characteristic of a fire event such as carbon monoxide, smoke, and heat, said sensors being known in the art. Although the preferred embodiment described herein and illustrated in the accompanying drawings shows three sensors, it is understood that the system described herein is easily adaptable to monitor the operability of a single or a plurality of fire event sensors. It is further understood that the system described herein is not constrained to a particular fire event detection device, but rather is adaptable for use in any such device. Sensors 210, 220, 230 receive current from a common power source 100 such as a battery, said sensors 210, 220, 230 continuously sending a data stream 240 to a programmable logic circuit 200 according to a predetermined time cycle. Said data stream 240 includes readings relative to the particular air condition being sensed as well as information relative to the strength of the power source 100. The logic circuit 200 will determine and initiate the appropriate output, which may include actuation of an audible and/or visual alarm 110, following comparison of sensor data with predetermined parameters.

Figure 2:
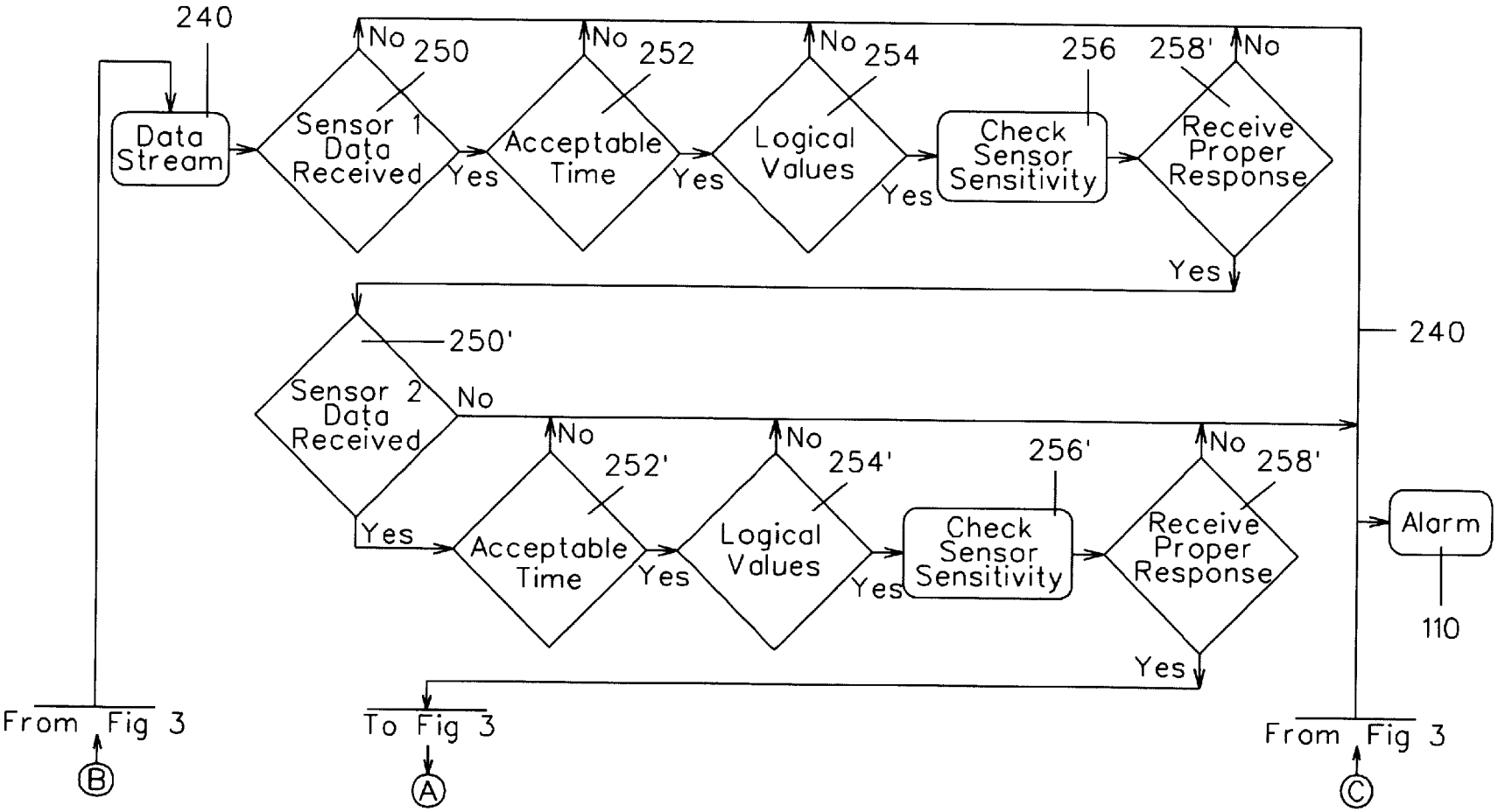
FIG. 2 is a flow chart showing the logic utilized by a programmable logic circuit.
Figure 3:
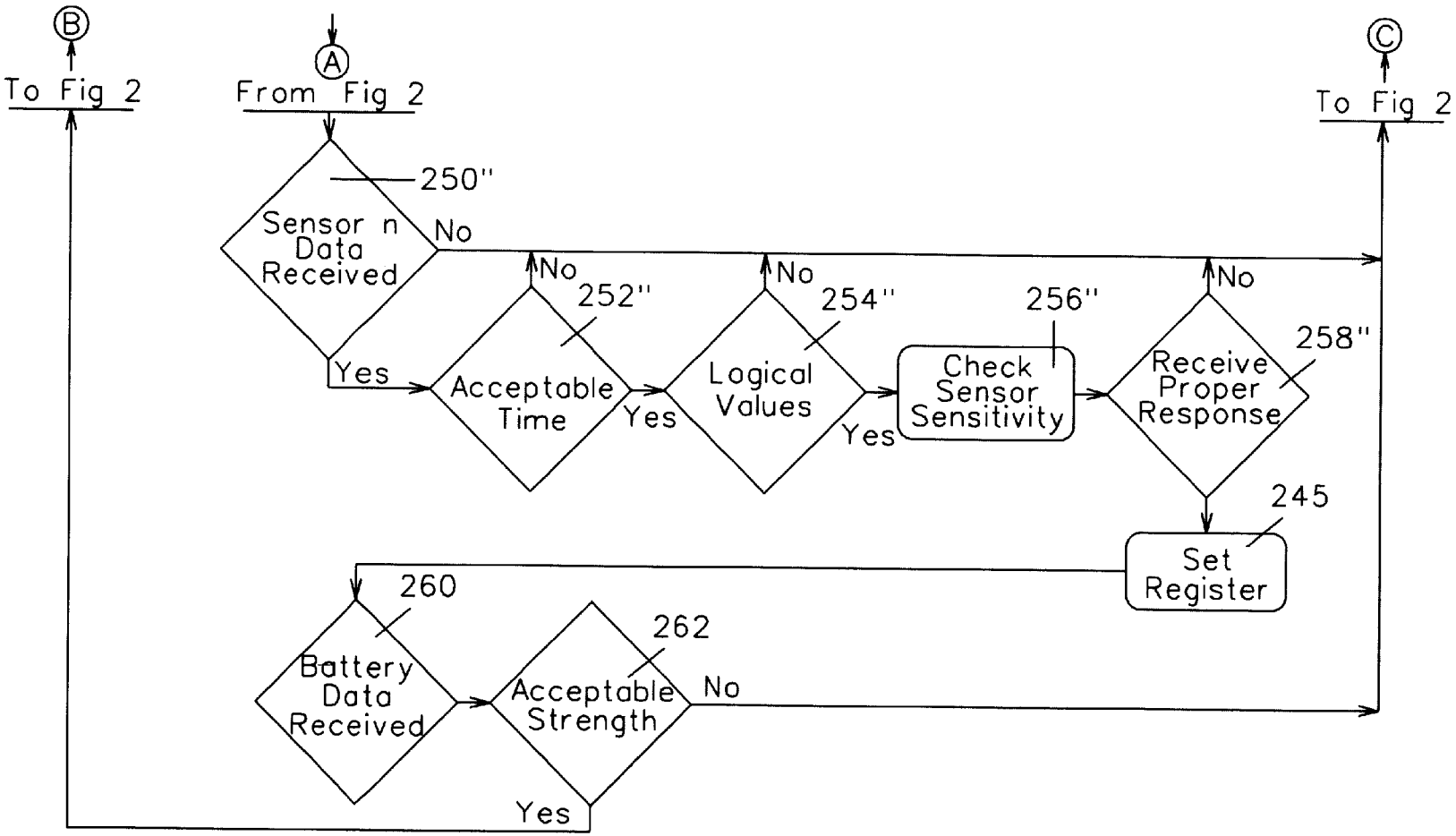
FIG. 3 is a flow chart showing the logic utilized by a programmable logic circuit.
Figure 4:
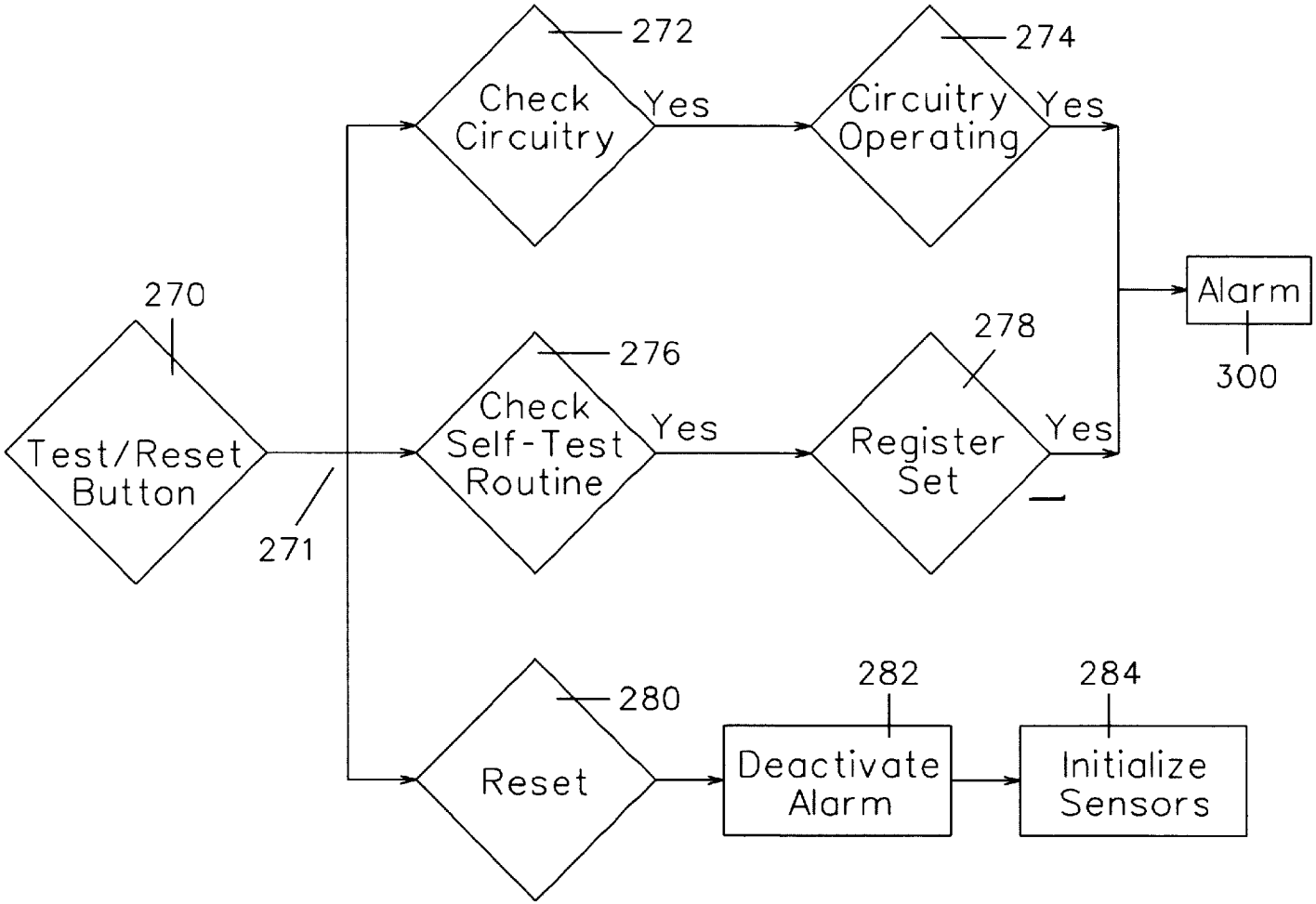
FIG. 4 is a flow chart showing the logic utilized by a programmable logic circuit.

FIGS. 2 and 3 present a flow chart showing the logic followed by the programmable logic circuit 200 for analyzing a data stream 240 to verify the operability of each sensor 210, 220, 230. It is understood that the particular parameters illustrated in FIGS. 2 and 3 are easily reprogrammable to facilitate various types of sensors that may be utilized or merely to modify the parameters which define "operability". The logic circuit 200 checks 250 whether any data has been received from a first sensor 210. Lack of data from said first sensor 210 may indicate said first sensor 210 is malfunctioning; thus, an audible and/or visual alarm is activated 110. If data from the first sensor 210 was received, the elapsed time since a prior reading was delivered is calculated and compared to a predetermined time parameter 252. If the elapsed time exceeds the parameter, an alarm is activated 110. However, if the prior tests 250, 252 are satisfied, the circuit 200 performs a qualitative data check 254, activating an audible and/or visual alarm 110 if the data is illogical when compared to predetermined parameters. Next, the circuit 200 checks the sensitivity of said first sensor 210 relative to the appropriate air condition according to predetermined parameters 256. Some types of fire event sensors such as heat or carbon monoxide sensors, can be tested by sampling surrounding ambient air or by sampling a thermometer. Other sensors, such as smoke sensors, can be tested by electrically simulating a fire event or by monitoring expected electronic pulses within the sensor circuitry using methods known in the art. If an appropriate response to the test 256 is not returned 258, an alarm is activated 110 to indicate a malfunctioning sensor.

In like manner, the logic circuit 200 proceeds to compare (250'–258') the data received from the next sensor 220 with parameters particular to the sensor 220, and so on (250"–258") for as many sensors 230 as are housed within a detection device. The operability of each sensor 210, 220, 230 within a detection device is thereby silently monitored until a malfunction is detected. When the operability of all sensors has been verified, a register 245 is set which indicates the self-checking routine is functioning. It is understood that said register 245 is periodically automatically reset to avoid inaccurate verification if the self-checking routine subsequently fails. Manual verification of the self-checking routine is further described later. Receipt of data from the power source 100 is also monitored 260. If the strength of the power source falls below a predetermined level 262, an audible and/or visual alarm is activated 110.

If a test/reset button of the type typically found on fire event sensing devices is engaged 270, the logic circuit 200 processes a decision tree 271. If a manual check of the detection unit circuitry is requested 272, the circuit checks the circuitry 274 and activates a momentary alarm 300 if the circuitry is operable. If a manual check of the self-checking routine itself is requested 276, the circuit 200 checks 278 the previously referenced register 245 and activates a momentary alarm 300 if the register is set. If a reset of all sensors is requested 280, the alarm 110, if sounding, is deactivated 282 and all sensors are initialized 284 to once again begin sensing and delivering readings to the logic circuit 200.

It is understood that the output signal 240 resulting from each sensor malfunction can vary so that the resulting alarm signal will likewise vary. Thus the suer can determine which sensor is malfunctioning according to the type of alarm. Also within each sensor logic different signals can be produced according to the type of parameter malfunction so that the user can determine the type of malfunction within each sensor.

Accordingly, it can be seen that this system can monitor the operability of a plurality of fire event sensors by continuously comparing sensor data to a set of parameters. The set of parameters is modifiable with no addition or change in circuitry.

Although a now preferred embodiment of the invention has been above described it is not to be limited thereto except as set forth in the following claims and allowable equivalents thereof.

Having thus described the invention, what is claimed as new and desired to be secured by Letters Patent is as follows:

1. A device for determining the efficacy of an air condition detector utilizing at least one sensor to provide a data signal corresponding to a preselected parameter of a condition of the ambient air, said device comprising:

an alarm;

a programmable logic circuit capable of evaluating input data supplied thereto, said circuit including means for generating an output signal to energize said alarm;

a power source for said alarm and programmable logic circuit;

means for providing said input data to said circuit for evaluation indicative of operation of said power source, said circuit generating said signal for energizing said alarm if said evaluated power source input data indicates an undesirable operation of said power source;

means for providing said input data to said circuit for evaluation indicative of operation of the at least one sensor in the detector, said circuit generating said signal for energizing said alarm if said evaluated sensor operation input data indicates an undesirable operation of the at least one sensor; and means for providing said input data to said circuit for evaluation indicative of an elapsed time between the receipt by said circuit of successive data signals provided by the at least one sensor, said circuit including means for comparing said elapsed time to a predetermined time parameter, said circuit generating said signal for energizing said alarm if said elapsed time is at an undesirable relationship with said predetermined time parameter, whereby to continuously monitor the efficacy of said detector.

2. The device as claimed in claim 1 wherein said means for providing input data for evaluation indicative of operation of the at least one sensor comprises a preselected data type parameter in said logic circuit indicative of a desirable type of preselected condition to be measured by the at least one sensor, said data type parameter utilized in said logic circuit evaluation for comparison with said input data received from the at least one sensor indicative of the data type of condition measured by the at least one sensor.

3. The device as claimed in claim 2 wherein said data type parameter is a preselected carbon monoxide condition of the ambient air measured by the at least one sensor.

4. The device as claimed in claim 1 wherein said means for providing data for evaluation indicative of operation of said power source comprises a preselected parameter in said logic circuit indicative of a desirable operation of said power source, said power source parameter utilized in said logic circuit evaluation for comparison with said input data indicative of operation of said power source.

5. The device as claimed in claim 4 wherein said preselected parameter indicative of a desirable operation of said power source comprises a voltage.

6. A device as claimed in claim 1 wherein said power source comprises a battery.

7. A device as claimed in claim 1 further comprising a means for user verification that said logic circuit has evaluated input data indicative of operation of the at least one sensor.

8. The device as claimed in claim 7 wherein said user verification means comprises a signal energized upon said evaluation by said logic circuit of said input data indicative of operation of the at least one sensor.

9. A method for determining the efficacy of an air condition detector utilizing at least one sensor to provide a signal corresponding to a preselected parameter of a condition of the ambient air, said method comprising the steps of:

providing an alarm;

providing a programmable logic circuit;

providing a power source for said alarm and programmable logic circuit;

providing data to said circuit for evaluation indicative of operation of said power source;

energizing said alarm if the evaluated power source data indicates an undesirable operability of said power source;

providing data to said circuit for evaluation indicative of operation of the at least one sensor in the detector;

energizing said alarm if said evaluated sensor data indicates an undesirable operability of the at least one sensor;

measuring an elapsed time between the receipt of successive signals from the at least one sensor;

providing said measured elapsed time to said circuit for comparison to a predetermined time parameter;

energizing said alarm if said measured elapsed time is at an undesirable relationship relative to said time parameter; and repeating said above steps to continuously monitor the efficacy of said detector.

10. The method as claimed in claim 9 further comprising the step of providing the logic circuit with a preselected parameter corresponding to the type of ambient air condition to be sensed by the at least one sensor, said condition parameter used by said programmable logic circuit for comparison with said data provided to said circuit for evaluation indicative of operation of the at least one sensor; and energizing said alarm if said condition parameter and said data indicative of sensor operation are at an undesirable relationship.

11. The method as claimed in claim 9 wherein said step of providing data to said circuit for evaluation indicative of operation of said power source includes comparing said data indicative of operation of said power source with a predetermined parameter indicative of a desired strength of said power source; and energizing said alarm if said provided power source operation data is at an undesirable relationship with said power source strength parameter.

12. The method as claimed in claim 9 further comprising the step of verifying that said steps of claim 9 have been performed by said logic circuit.

13. A method for determining the efficacy of an air condition detector utilizing at least one sensor to provide data corresponding to a preselected parameter of a condition of the ambient air, said method comprising the steps of:

providing an alarm;

providing a programmable logic circuit;

providing a power source for said alarm and programmable logic circuit;

providing data to said circuit indicative of operation of the at least one sensor in the detector, said data including a parameter in said logic circuit corresponding to the type of data to be sensed by the at least one sensor and data measured by operation of the at least one sensor;

utilizing said logic circuit to compare said data type parameter with said data measured by the at least one sensor;

generating a signal in said logic circuit if said data type sensed by the at least one sensor does not match said data type of said parameter, said signal energizing said alarm;

repeating said above steps to continuously monitor the efficacy of said detector.

14. The method as claimed in claim 13 further comprising the step of:

measuring an elapsed time between the successive receipt of discrete data from the at least one sensor;

providing said elapsed time to said logic circuit for comparison to a predetermined time parameter;

generating a signal in said logic circuit for energizing said alarm if said elapsed time is not less than said time parameter.

15. The device as claimed in claim 2 wherein said data type parameter is a preselected smoke condition of the ambient air measured by the at least one sensor.

16. The device as claimed in claim 2 wherein said data type parameter is a preselected heat condition of the ambient air measured by the at least one sensor.

17. A device for determining the efficacy of an air condition detector utilizing at least one sensor to provide a data signal corresponding to a preselected parameter of a condition of the ambient air, said device comprising:

a programmable logic circuit capable of evaluating input data supplied thereto;

a power source for said programmable logic circuit;

means for providing said input data to said circuit for evaluation indicative of operation of said power source;

means in said circuit for generating an alarm signal if said evaluated power source input data indicates an undesirable operation of said power source;

means for providing said input data to said circuit for evaluation indicative of operation of the at least one sensor in the detector;

means in said circuit for generating an alarm signal if said evaluated sensor operation input data indicates an undesirable operation of the at least one sensor; and means for providing said input data to said circuit for evaluation indicative of an elapsed time between the receipt by said circuit of successive data signals provided by the at least one sensor, said circuit including means for comparing said elapsed time to a predetermined time parameter;

means in said circuit for generating an alarm signal if said elapsed time is at an undesirable relationship with said predetermined time parameter, whereby to continuously monitor the efficacy of said detector.

18. A method for determining the efficacy of an air condition detector utilizing at least one sensor to provide a signal corresponding to a preselected parameter of a condition of the ambient air, said method comprising the steps of:

providing a programmable logic circuit;

providing a power source for said programmable logic circuit;

providing data to said circuit for evaluation indicative of operation of said power source;

generating an alarm signal if the evaluated power source data indicates an undesirable operability of said power source;

providing data to said circuit for evaluation indicative of operation of the at least one sensor in the detector;

generating an alarm signal if said evaluated sensor data indicates an undesirable operability of the at least one sensor;

measuring an elapsed time between the receipt of successive signals from the at least one sensor;

providing said measured elapsed time to said circuit for comparison to a predetermined time parameter;

generating an alarm signal if said measured elapsed time is at an undesirable relationship relative to said time parameter.

19. A device for determining the efficacy of an air condition detector utilizing at least one sensor to provide a data signal corresponding to a preselected parameter of a condition of the ambient air, said device comprising:

an alarm;

a programmable logic circuit capable of evaluating input data supplied thereto, said circuit including means for generating an output signal to energize said alarm;

a power source for said alarm and programmable logic circuit; and means for providing said input data to said circuit for evaluation indicative of an elapsed time between the receipt by said circuit of successive data signals provided by the at least one sensor, said circuit including means for comparing said elapsed time to a predetermined time parameter, said circuit generating said signal for energizing said alarm if said elapsed time is at an undesirable relationship with said predetermined time parameter, whereby to continuously monitor the efficacy of said detector.

20. The device as claimed in claim 19 further comprising means for providing said input data to said circuit for evaluation indicative of operation of the at least one sensor in the detector, said circuit generating said signal for energizing said alarm if said evaluated sensor operation input data indicates an undesirable operation of the at least one sensor.

* * * * *